US007540229B2

(12) United States Patent
Seo et al.

(10) Patent No.: US 7,540,229 B2
(45) Date of Patent: Jun. 2, 2009

(54) EXPLOSIVE REACTIVE ARMOR WITH MOMENTUM TRANSFER MECHANISM

(75) Inventors: Yongseok Seo, Seongnam (KR); Jeong-Tae Kim, Daejeon (KR); Chang Choi, Daejeon (KR)

(73) Assignee: Agency for Defense Development, Daejeon (KR)

( * ) Notice: Subject to any disclaimer, the term of this patent is extended or adjusted under 35 U.S.C. 154(b) by 0 days.

(21) Appl. No.: 11/109,206

(22) Filed: Apr. 19, 2005

(65) Prior Publication Data

US 2006/0086243 A1 Apr. 27, 2006

(30) Foreign Application Priority Data

Oct. 18, 2004 (KR) ..... 10-2004-0083303

(51) Int. Cl.
*F41H 5/007* (2006.01)

(52) U.S. Cl. ..... 89/36.17; 89/36.02; 89/36.08

(58) Field of Classification Search ..... 89/36.17, 89/36.01, 36.02, 36.08, 36.09; 428/911; 109/36, 37

See application file for complete search history.

(56) References Cited

U.S. PATENT DOCUMENTS

| | | | | | |
|---|---|---|---|---|---|
| 3,611,932 | A | * | 10/1971 | Clator | 102/305 |
| 4,236,463 | A | * | 12/1980 | Westcott | 109/33 |
| 4,979,425 | A | * | 12/1990 | Sprague | 89/36.02 |
| 5,070,764 | A | * | 12/1991 | Shevach et al. | 89/36.17 |
| 5,293,806 | A | | 3/1994 | Gonzalez | |
| 5,413,027 | A | * | 5/1995 | Mixon | 89/36.17 |
| 5,637,824 | A | * | 6/1997 | Benyami | 89/36.17 |
| 6,021,703 | A | | 2/2000 | Geiss et al. | |
| 6,619,181 | B1 | * | 9/2003 | Frey et al. | 89/36.17 |
| 6,880,445 | B2 | * | 4/2005 | Benyami et al. | 89/36.17 |
| 2006/0060077 | A1 | * | 3/2006 | Lucuta et al. | 89/36.02 |

FOREIGN PATENT DOCUMENTS

| | | | |
|---|---|---|---|
| DE | 4440120 | A1 | 5/1996 |
| DE | 3708927 | C1 | 10/1998 |
| DE | 101 19596 | A1 | 10/2002 |
| RU | 12237 | U1 | 12/1999 |

OTHER PUBLICATIONS

Yongseok Seo, et al., "Momentum Transfer Mechanism for Explosive Reactive Armor to Improve Effectiveness Against Normal Impact", 21st International Symposium on Ballistics, vol. 2, pp. 935-940, (2004).

* cited by examiner

*Primary Examiner*—Michael Carone
*Assistant Examiner*—Benjamin P Lee
(74) *Attorney, Agent, or Firm*—Scully, Scott, Murphy & Presser, P.C.

(57) ABSTRACT

Disclosed is an explosive reactive armor with a momentum transfer mechanism by developing a new protection mechanism in which a momentum transfer mechanism by detonation of a reactive material is integrated with a thickness increase mechanism. In this explosive reactive armor with the momentum transfer mechanism, a flying element always travels with a vertical angle or a slant angle with respect to an ongoing direction of the threat such that a momentum of the flying element is transferred to the threat effectively. As a result of this, shear force is induced over an entire length of the threat and thus the threat can be destroyed. Therefore, a protection effect can always be achieved regardless of an impact angle of the threat. Also, a protection capability can be achieved even in case of a vertical impact which is the most vulnerable case for the existing explosive reactive armor.

8 Claims, 13 Drawing Sheets

EXPLOSIVE REACTIVE ARMOR WITH MOMENTUM TRANSFER MECHANISM

BACKGROUND OF THE INVENTION

1. Field of the Invention

The present invention relates to an explosive reactive armor for use in combat vehicles, and particularly, to an explosive reactive armor with a momentum transfer mechanism which is capable of providing a protection effect regardless of the incident angle of a threat including a right angle of incident threat.

2. Description of the Prior Art

In general, explosive reactive armor, as shown in FIG. 1, is a protection mechanism fixed to the exterior of a combat vehicle (e.g., an armored vehicle) by bolting or other means, for protecting the combat vehicle from an external threat such as the penetrator or jet of a warhead or the like. Referring to FIG. 2A, a prior explosive reactive armor 10 is installed at an outer surface 25 of the combat vehicle so as to form a slope angle inclined ($\alpha$) with respect to the vertical and includes a reactive material 13 such as a high explosive charge filled within a casing between a front flying plate 11 and a rear plate 12. After an external threat 2 such as a bullet or a projectile makes an impact on the explosive reactive armor 10, if the threat 2 penetrates the front flying plate 11 of the explosive reactive armor 10 and arrives at the reactive material 13, as a result, the reactive material 13 is detonated. By the detonation of the reactive material 13, the front flying plate 11 and rear plate 12 of the explosive reactive armor 10 are flung in the counter directions shown by the arrows in FIG. 2B. Therefore, the intersecting position between the threat 2 and the front flying plate 11 moves along a line of the front plate 11 thereby forming a longitudinally shaped of a penetration opening 11' as shown in FIG. 3. During this "sliding" on the front plate 11, the threat 2 is destroyed by degrees. Thus, when it arrives at the actual surface 25 of the combat vehicle 20, the momentum of the threat 2 has been already significantly dissipated, so that damage to the combat vehicle 20 is remarkably decreased in spite of the threat having impacted.

That is, when the threat 2 impacts on the front flying plate 11 of the explosive reactive armor 10, the reactive material 13 filled in the gap between the front and rear flying plates 11 and 12 detonates by the shock pressure generated during the impact, and then the front and rear flying plates 11 and 12 are flung in, the perpendicular direction to the explosive installation surface by the detonation energy of the explosive 13. During this progress, the front and rear flying plates 11 and 12 interact with the threat and destroy or disrupt the threat. As a result, a protection effect can be achieved. In such arrangement, a dynamic plate thickness effect may be referred to as a significant protection mechanism between the explosive reactive armor and the threat. Herein, the dynamic plate thickness effect refers to the effect achieved by continuously interposing an intact material across a flight path of the threat while the front and rear flying plates 11 and 12 fly and thus substantially increasing an effective thickness of the material. Most explosive reactive armors have been developed to provide such a protection mechanism.

However, it has been known that, when the threat 2 impacts on an explosive reactive armor 10 based on the dynamic plate thickness effect, the protection effect can be achieved only in case of having a relative slope angle (between the explosive reactive armor 10 and the threat 2) of more than a certain degree (e.g., a slope $\alpha$ of more than about 60°), and thus the protection effect is remarkably reduced when the relative slope is decreased. This is due to the phenomenon that, when the slope $\alpha$ is not enough, a middle/rear portion of the threat penetrates the front and rear flying plates 11 and 12 without any interaction through an opening formed by a penetration of the front end of the threat. However, when the explosive reactive armor 10 is mounted on a combat vehicle 20 such as a tank or an armored vehicle, the explosive reactive armor 10 may be impacted perpendicularly by a threat. Thus, it is vulnerable for failing to achieve the purpose of providing a protection capability.

Even in case that the explosive reactive armor 10 is impacted obliquely by the threat, i.e., at a slant, the protection effect can vary depending on the length of the threat. While initiating a movement of the flying plates 11 and 12, in case of a shaped charge jet or a penetrator having a relatively long projectile, the front portion of the projectile may pass through the explosive reactive armor 10 while only the rear portion thereof is disturbed by the explosive reactive armor 10. This mechanism can still achieve a protection effect. On the other hand, in case of an explosively formed penetrator (EFP) having a relatively short projectile, the entire projectile may pass through the flying plates before the flying plates sufficiently initiate their movement. As a result, there has been a problem that it is impossible to achieve the desired protection effect.

SUMMARY OF THE INVENTION

Therefore, to solve the above problem, it is an object of the present invention to provide a new mechanism of an explosive reactive armor for thereby improving the interaction between a threat and an explosive reactive armor and maintaining a protection capability regardless of the impact angle including a right angle.

According to another object of the present invention, there is provided an explosive reactive armor capable of ensuring a superior protection capability even when a length of the threat is short, by promoting an interaction between the explosive reactive armor and a threat, and by inducing a multi-interaction between flying plates and a projectile so as to disturb the threat.

To achieve these and other advantages of the present invention, as embodied and broadly described herein, there is provided an explosive reactive armor with a momentum transfer mechanism comprising: a front plate member; a rear plate member coupled to the front plate member; and a reactive material continuously filled within closed loop formed by the coupled front and rear plate members.

In order to realize the protection of an object by reducing a momentum of a threat when the threat from the outside penetrates the front plate member of the explosive reactive armor, when the reactive material continuously filled up within the closed loop detonates, the detonation wave moves along the closed loop faster than the threat, thereby changing an ongoing direction of the threat and simultaneously disrupting it into many pieces.

The closed loop is preferably formed as a triangle or other polygon, or a semi-cylindrical or a hemicyclic shape. When the closed loop is formed as the triangle, the detonation wave moves advantageously the fastest.

On the other hand, the front plate member may be formed in a flat shape, while the rear plate member may be formed in a curved or a hemispherical shape.

The front and rear plate members are formed of pairs of spaced plates, respectively. And it is desirable to fill the reactive material into a gap between the pairs of spaced plates. The reactive material may fill in all the gap between the pairs of plates forming the front and rear plate members.

Flying elements, on the other hand, may additionally be mounted on an outer surface of the pairs of plates forming the front plate member, or on an inner surface of the pairs of plates forming the rear plate member. Accordingly, when the threat penetrates the front plate member and the detonation propagates along the closed loop, the flying elements move toward the inside of the closed loop as the detonation wave moves faster than the threat, which induces an interaction between the flying elements and the threat, thus to reduce a momentum of the threat and further to disrupt the threat.

The flying elements may be formed of at least one material among metals, ceramic materials, composite materials, or the like. In particular, when the ceramic materials are applied to the flying element, as the ceramic materials are light enough to increase a flight speed, thus, it can greatly reduce the kinetic energy of the threat when the threat impacts thereon.

It is desirable that a plurality of flying elements may also be formed.

On the other hand, the rear plate member may be formed by connecting two or more flat plate members which is formed as pairs of plates, and the flying elements may be mounted on only some of the two or more flat plate members which is formed as pairs of plate members.

Also, the rear plate member may be formed by connecting two pairs of flat plate members, in which the angle between the two plate members may be variable from 80° to 100°. The flying elements may be mounted on only one of the two flat plate members.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Description will now be given in detail to the preferred embodiments of the present invention, examples of which are illustrated in the accompanying drawings.

Figure 4:
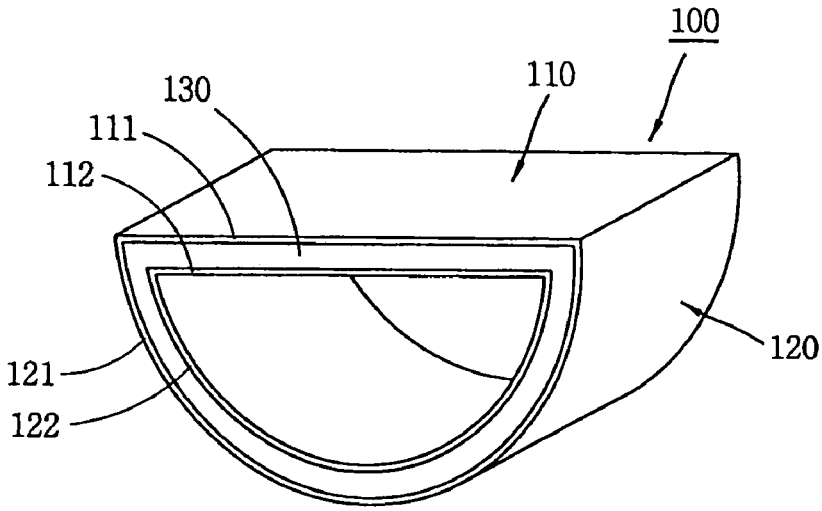
FIG. 4 is a perspective view illustrating the construction of an explosive reactive armor with a momentum transfer mechanism in accordance with a first embodiment of the present invention.

FIG. 4 is a perspective view showing the construction of an explosive reactive armor with a momentum transfer mechanism in accordance with a first embodiment of the present invention. The explosive reactive armor 100 with the momentum transfer mechanism according to the present invention includes: a front plate member 110 formed of a pair of flat spaced apart plates 111 and 112; a hemi-cylindrical rear plate member 120 formed of two concentric curved spaced apart plates 121 and 122 which are connected to the corresponding two flat plates 111 and 112 of the front plate member 110, respectively; and a reactive material 130 such as a high explosive charge filling in the gap between each of the two plates of the front plate member 110 and the rear plate member 120.

Herein, the reactive material 130 forms a continuous closed loop. As a result, when detonation occurs at a certain point, the detonation propagates along the reactive material 130 from the initial detonation site. A hemi-cylindrical space formed inside the explosive reactive armor may remain empty as it is shown in FIG. 4 or shown in FIG. 5, may be used for installation of flying elements 140 made of ceramics, composite materials and/or metal plates according to the design of the reactive armor.

Figure 1:
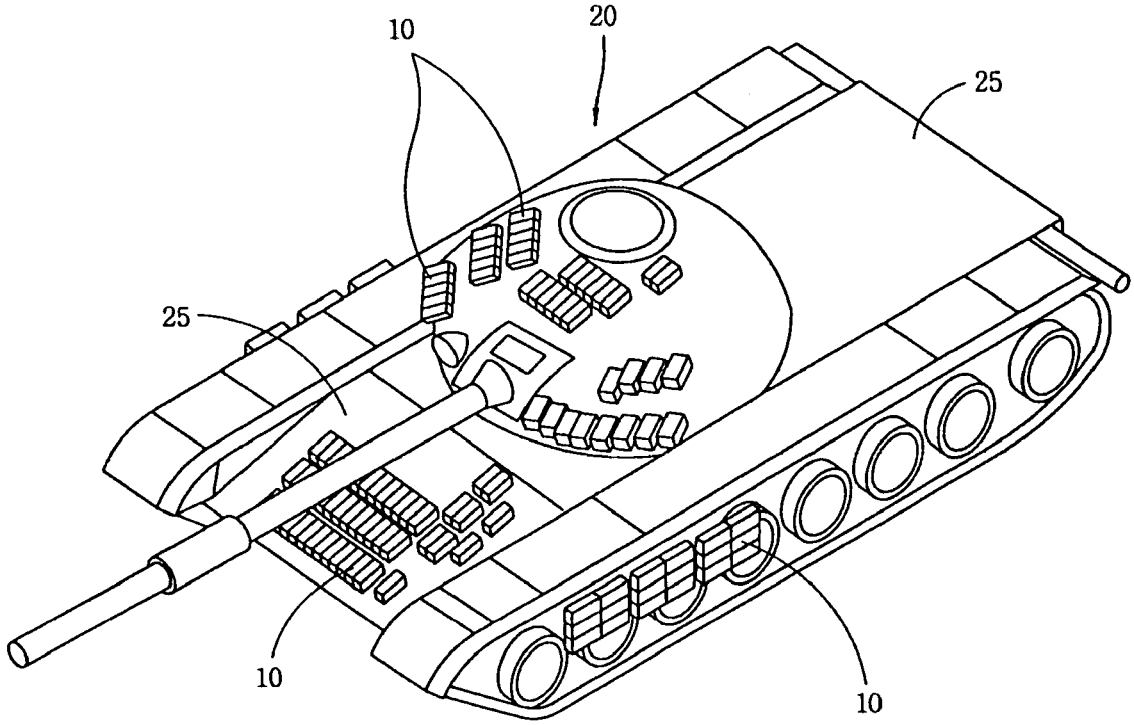
FIG. 1 Prior Art
FIG. 1 is a perspective view illustrating the construction of a combat vehicle on which explosive reactive armor is mounted.
Figure 2A:
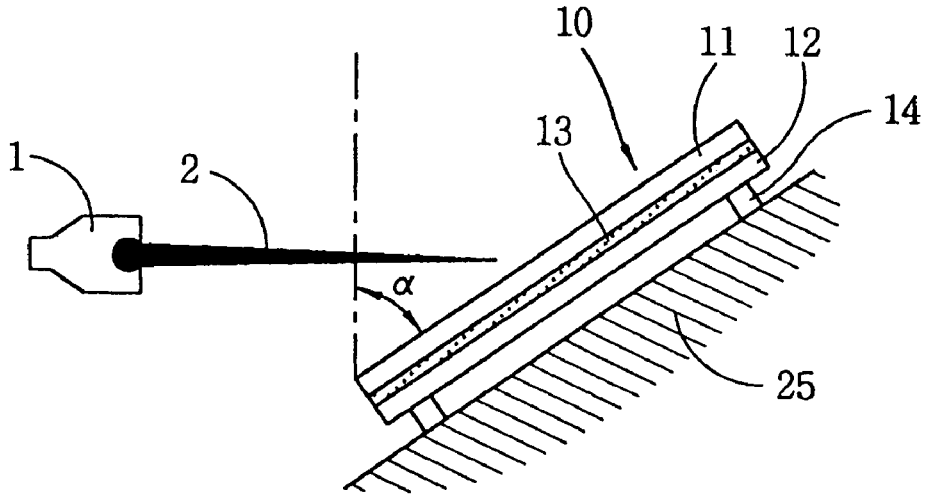
FIG. 2A Prior Art
FIGS. 2A through 2D are sequential schematic views illustrating the construction and an operation of a prior explosive reactive armor.
Figure 2B:
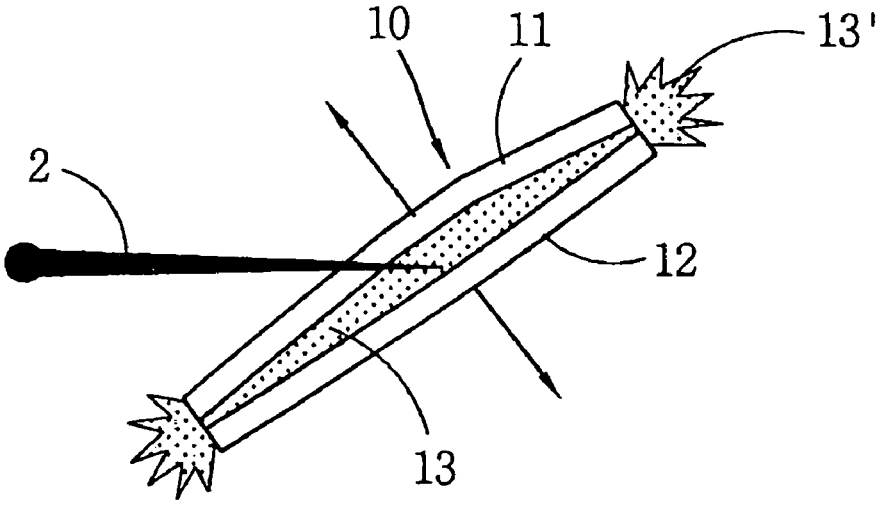
FIG. 2B Prior Art
Figure 2C:
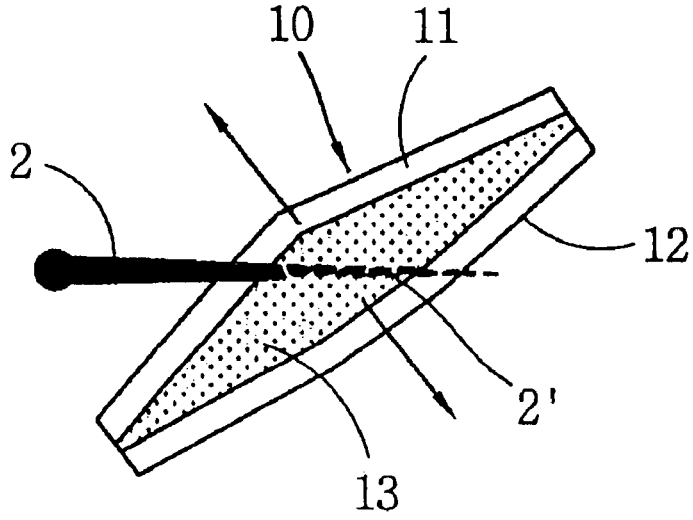
FIG. 2C Prior Art
Figure 2D:
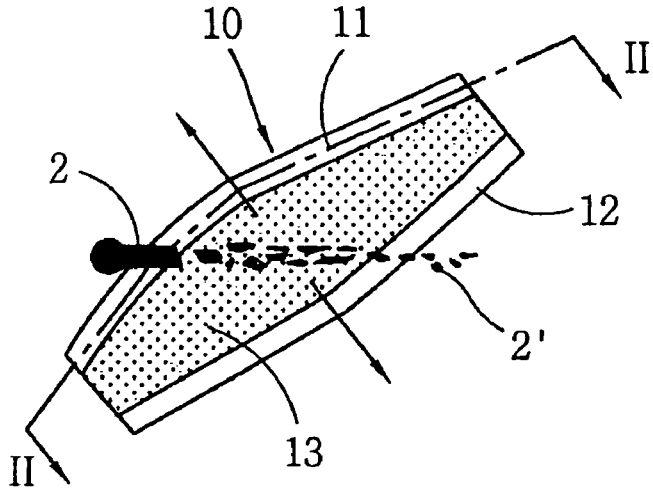
FIG. 2D Prior Art
Figure 3:
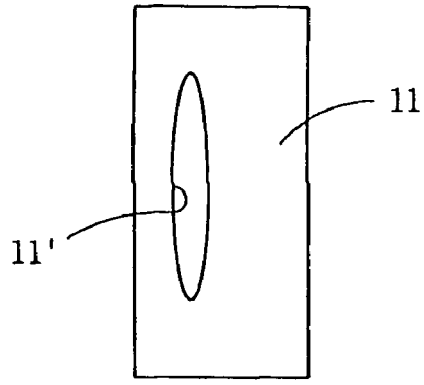
FIG. 3 Prior Art
FIG. 3 is a schematic view illustrating the shape of a front flying plate after the operation of the prior explosive reactive armor.
Figure 8A:
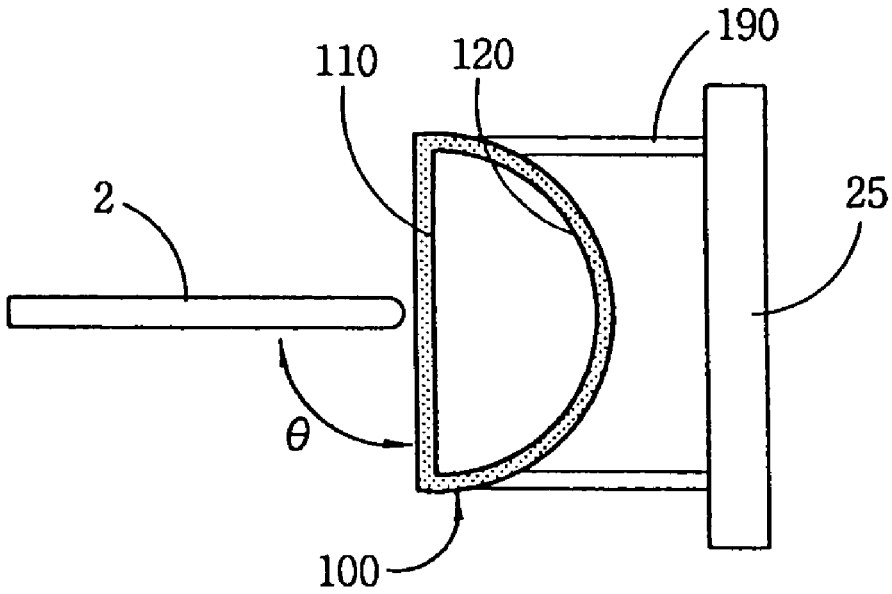
FIGS. 8A through 8H are sequential schematic views illustrating the operation of the explosive reactive armor with the momentum transfer mechanism in accordance with the first embodiment of the present invention with respect to a threat which impacts perpendicularly (i.e., normally)

Furthermore, the front outer plate 111 forming the front plate member 110 may be integrated with the rear outer plate 121, and the front inner plate 112 may be integrated with the rear inner plate 122. Here, those plates may be coupled by bolts, welding, or clamping. As shown in FIG. 1, on the other hand, the explosive reactive armor 100 can be mounted on the outer surface 25 of a combat vehicle by using a separate frame (not shown) or a bar, or by using various ways such as with Velcro type hook and loop fastening strips or by bolts 190 as shown in FIG. 8A.

A general explosive such as Comp. B, Comp. C4, and the like, or a plastic bonded explosive (PBX) which has adjustable insensitivity can be applied as the reactive material 130.

Now, the operational principle of such thusly constructed first embodiment of the present invention will be explained.

Stage I: As shown in FIG. 8A, this stage is just before a threat 2 such as a projectile impacts on the explosive reactive armor. At this stage, just before the threat impacts on the explosive reactive armor with the momentum transfer mechanism 100 and the outer surface 25 of the combat vehicle to be protected, the threat approaches the reactive armor at an angle of 90° (the worst condition) thereto. Here, in order, as presented to the impinging threat, the explosive reactive armor with the momentum transfer mechanism 100 is comprised of the front outer plate 111, the reactive material 130, the front inner plate 112, the rear inner plate 122, and the rear outer plate 121.

Figure 8B:
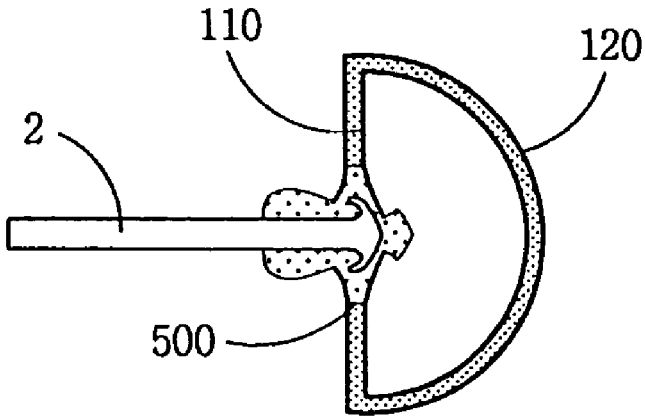

Stage II: As shown in FIG. 8B, Stage II is the initial stage when the threat 2 impacts on the explosive reactive armor 100. The threat 2 penetrates the front outer plate 111. The threat then impacts on the reactive material 130 so as to initiate a deformation at its tip. After detonation of the reactive material 130, a detonation wave 500 is generated and then propagates along the filled reactive material 130. During this time, the front outer plate 111 and the front inner plate 112 of the explosive reactive armor 100 initiate their deformation by the pressure generated when the reactive material 130 detonates.

Figure 8C:
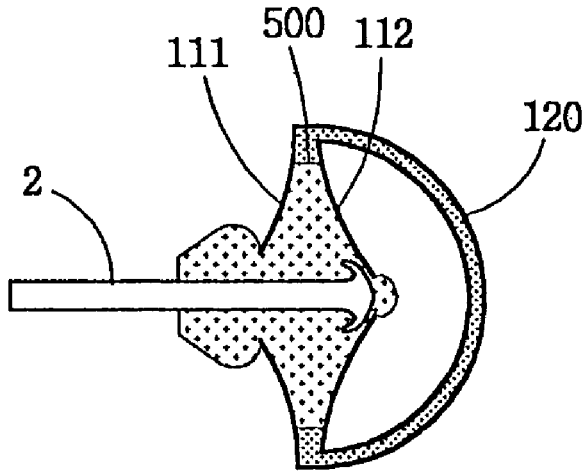

Stage III: As shown in FIG. 8C, the detonation wave 500 of the explosive propagates during this stage. The detonation wave 500 of the explosive propagates at about more than 8 km/sec and arrives at the edges of the front part of the explosive reactive armor 100. During this time, the threat 2 penetrates the reactive armor at a speed approximately 0.2~1 times (it depends on the speed of the threat 2) faster than that of the detonation wave 500. Here, the shock generated by detonation wave 500 of the reactive material 130 makes the threat 2 unstable through an interaction with the threat. Also, deformations of the front outer plate 111 and the front inner plate 112 are increased by the propagation of the detonation wave 500. As a result, the front outer plate 111 starts to fly in an opposite direction to which the threat 2 advances, and the front inner plate 112 in the following direction of the threat 2.

Figure 8D:
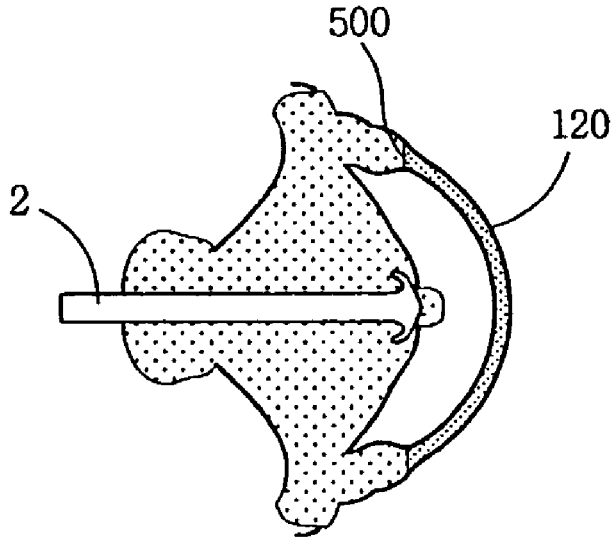

Stage IV: As shown in FIG. 8D, the rear plate member 120, which is an important main operational component of the explosive reactive armor 100 with the momentum transfer mechanism, initiates its behavior. As the detonation wave 500 of the reactive material 130 arrives to the rear plate member 120 of the explosive reactive armor 100, the reactive material 130 within the rear plate member 120 detonates before the threat 2 impacts thereon, and the rear inner plate 122 and the rear outer plate 121 are deformed and simultaneously initiate their movement. During this time, the threat 2 advances through the inner space of the explosive reactive armor 100. In this process, even if there may occur a difference depending on the impact position and propagation speed of the threat, an overall behavior is similar.

Figure 8E:
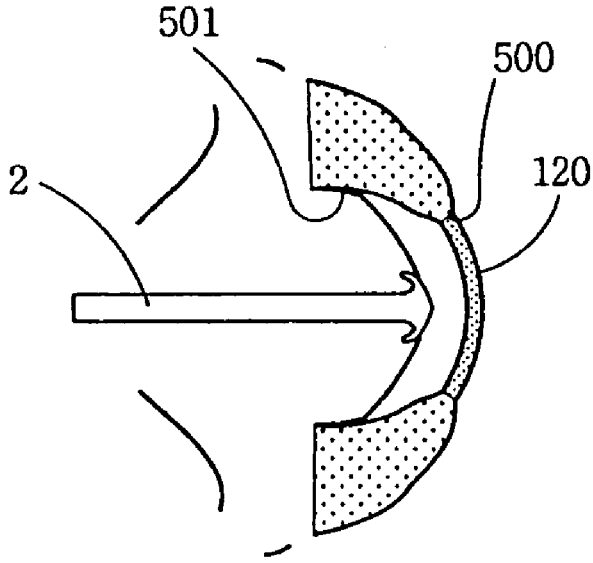

Step V: As shown in FIG. 8E, in this step, a new flight structure 501 is formed so as to disturb the threat. As the detonation wave 500 of the reactive material 130 propagates toward the center of the rear plate member 120, the front inner plate 112 and the rear inner plate 122 are pressed together by detonation pressure from the edge of the explosive reactive armor 100 and thus begin to form the new flight structure 501 (the flight structure may be formed in/of other shapes and materials according to the particular implementation chosen).

Figure 8F:
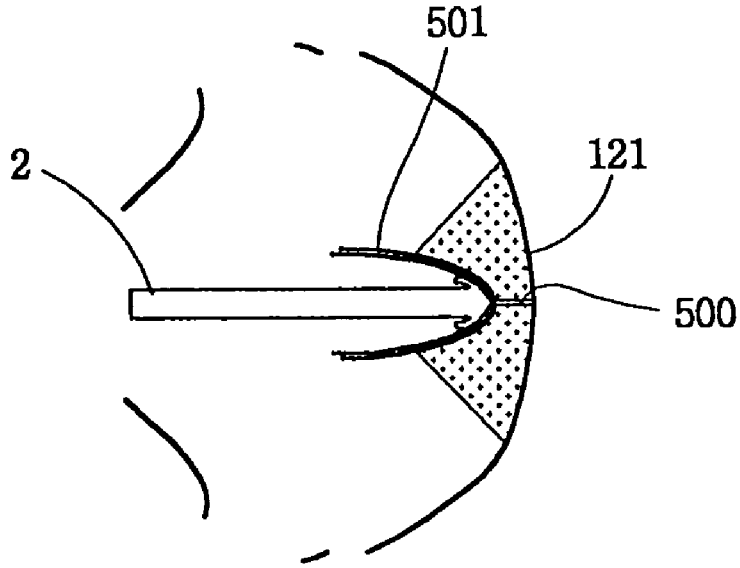

Step VI: As shown in FIG. 8F, in this stage, the detonation of the reactive material 130 is completed. Before the threat 2 arrives at the rear plate member 120 of the explosive reactive armor 100, the detonation wave 500 propagates all throughout the reactive material 130 of the explosive reactive armor 100. Thus, the flight structure 501 is formed more greatly and travels in a vertical direction with respect to the ongoing direction of the threat 2.

Figure 8G:
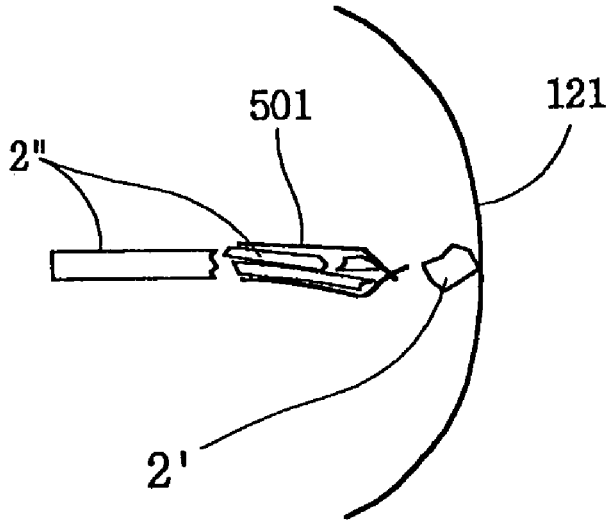

Step VII: As shown in FIG. 8G, the threat 2 interacts with the flight structure 501. This impact induces shear force to thereby destroy and disturb the threat 2. At this time, even if the front part 2' of the threat 2 passes the flight structure 501 and penetrates the rear outer plate 121 (the length of the part 2' may be a bit different depending on the speed of the threat), the middle/rear part following 2" of the threat 2 is continuously disturbed by the flight structure 501. Also, in addition to the interaction between the flight structure 501 and the threat 2, the detonation energy of the reactive material 130 disturbs the ongoing of the threat.

Figure 8H:
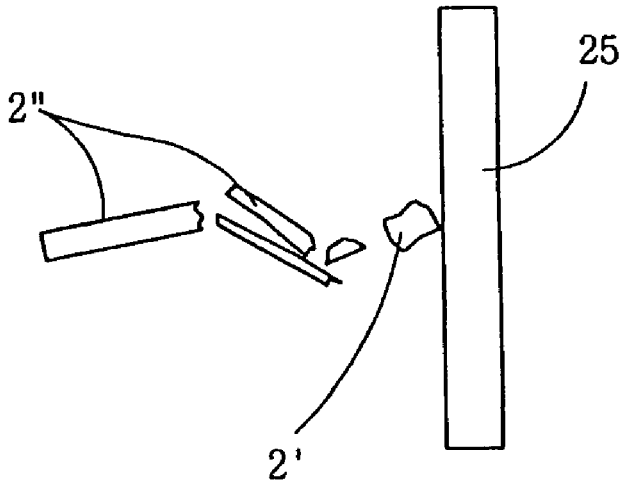
Figure 9A:
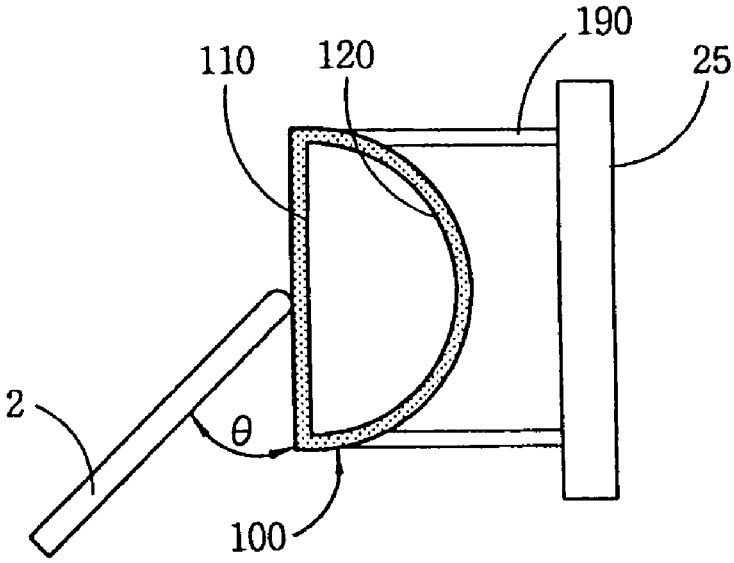
FIGS. 9A through 9F are sequential schematic views illustrating the operation of the explosive reactive armor with the momentum transfer mechanism in accordance with the first embodiment of the present invention with respect to a threat which impacts at a slant (i.e., obliquely).
Figure 9B:
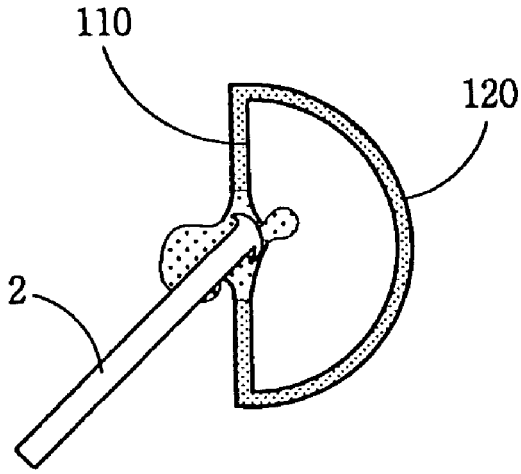
Figure 9C:
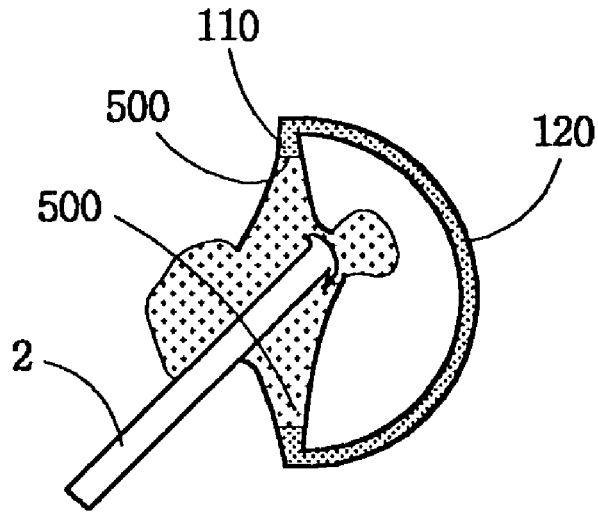
Figure 9D:
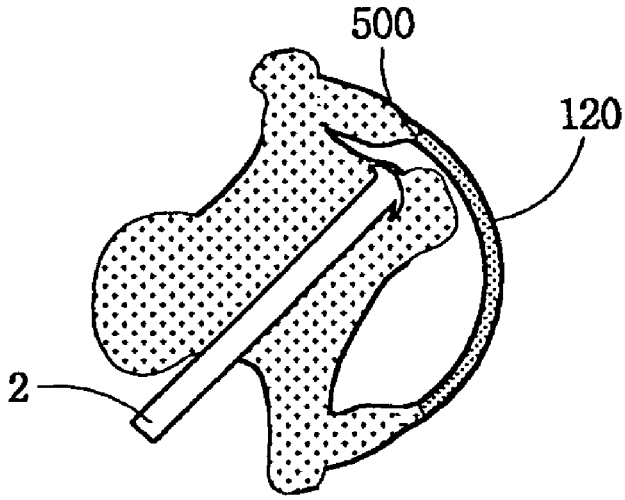
Figure 9E:
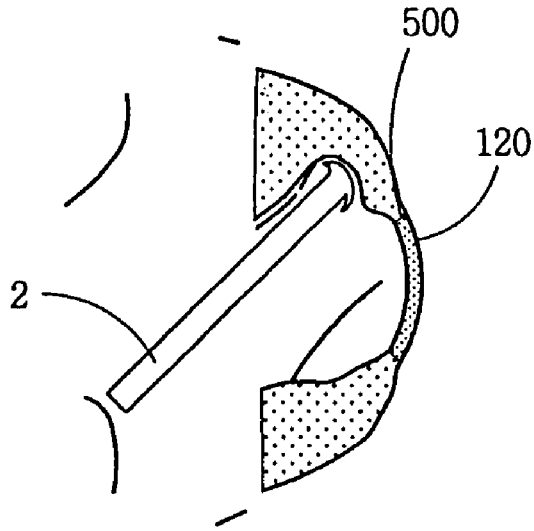
Figure 9F:
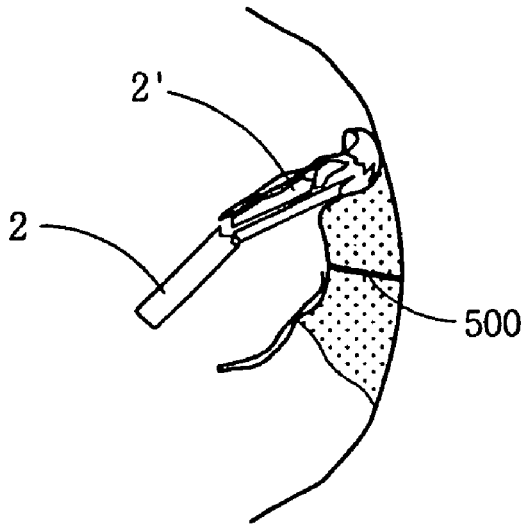

Stage VIII: As shown in FIG. 8H, in this stage, the threat 2 penetrates the outer surface 25 of the combat vehicle. The threat 2 having passed through the explosive reactive armor 100 arrives at the outer surface 25 of the combat vehicle in a destroyed or effectively dissipated state or a state that its flight path has been distorted. So, its penetration capability at impact is remarkably reduced compared with its initial penetration capability.

Summarizing such aforementioned operation mechanism, when the threat 2 impacts on the front plate member of the explosive reactive armor 100, the detonation wave 500 propagates through the continuously connected reactive material 130, and the reactive material 130 of the rear plate member 120 detonates before the threat 2 impacts thereon. At this time, the generated detonation energy accelerates the flight structures 112 and 122 to form a new structure 501. The structure 501 moves toward the ongoing direction of the threat 2 and also forms a high pressure field within the ongoing space of the threat 2. The flight structures 501 applies its momentum to the side of the threat according to the shape of the explosive reactive armor. The momentum induces a shear force in the threat to destroy it. Accordingly, a protection effect can be achieved. Also, the detonation energy of the reactive material 130 itself is transferred to the threat as a type of shock and thus the threat is destroyed and perturbed thereby to accomplish the protection capability. Therefore, the explosive reactive armor 100 with the momentum transfer mechanism can provide the protection capability as a type of transferring of the momentum of the reactive material and the flight structures formed thereby to the threat. Moreover, in the same way, as shown by the sequence of events in FIGS. 9A through 9F, the explosive reactive armor with the momentum transfer mechanism can provide the protection capability against an oblique impact due to the shape characteristics of the explosive reactive armor and the method of detonation. Additionally, it will be appreciated that the protection mechanism in case that the threat impacts obliquely has the similar behavior to the case of a perpendicular impact as shown in FIGS. 8A through 8H.

The explosive reactive armor 100 with the operational mechanism described above is mounted on the combat vehicle to be used as a protection device for coping with the threat 2 such as a kinetic energy projectile, a shaped charge jet, an EFP, or the like.

In accordance with the first embodiment of the present invention, the front plate member 110 is formed as a flat plate and the rear plate member 120 is designed as a curved plate, in order to provide a protection effect without regard to the threat's impact angle. A gap between the front plate member 110 and the rear plate member 120 is considered as a flight space of the rear inner plate 122. Forming the rear plate member 120 to have the curved surface is intended to disperse the detonation pressure when the explosive reactive armor 100 operates, which results in minimizing damage to the vehicle structure on which the explosive reactive armor 100 is mounted.

Figure 5:
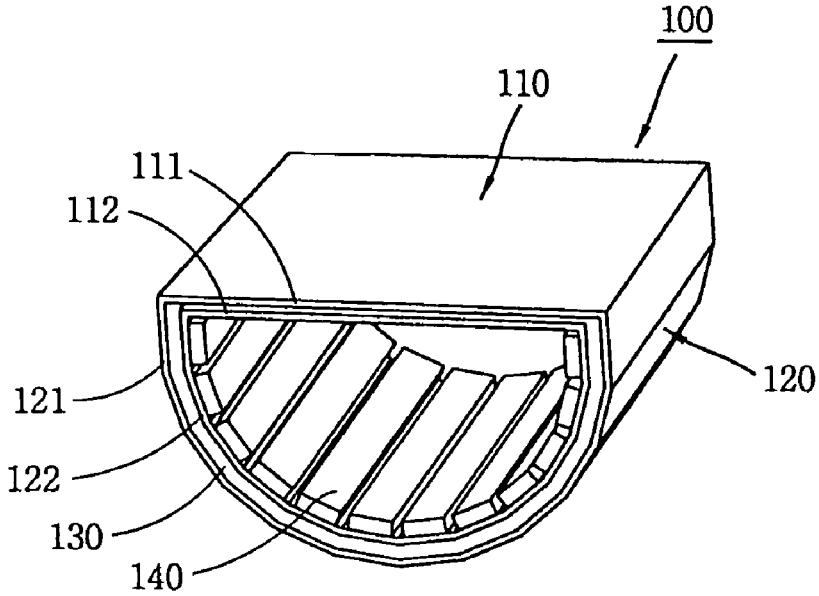
FIGS. 5, 6 and 7 are respective perspective views illustrating the construction of an explosive reactive armor with a momentum transfer mechanism in accordance with another embodiment of the present invention.

An explosive reactive armor 100 in accordance with a second embodiment of the present invention as shown in FIG. 5, on the other hand, may be adaptable for combating the threat 2 as explained in regard to the first embodiment, however, it has been proposed to further increase the protection capability against a threat 2 such as a kinetic energy projectile with a large mass and a long length. In detail, by mounting the flying elements 140 formed using metals, ceramics, composite materials or heterogeneous materials to the rear inner plate 122, the momentum transferred to the threat 2 is enhanced by increasing the mass of the flying plate (flying elements) 140, which improves the protection effect against a threat with a large mass.

Figure 6:
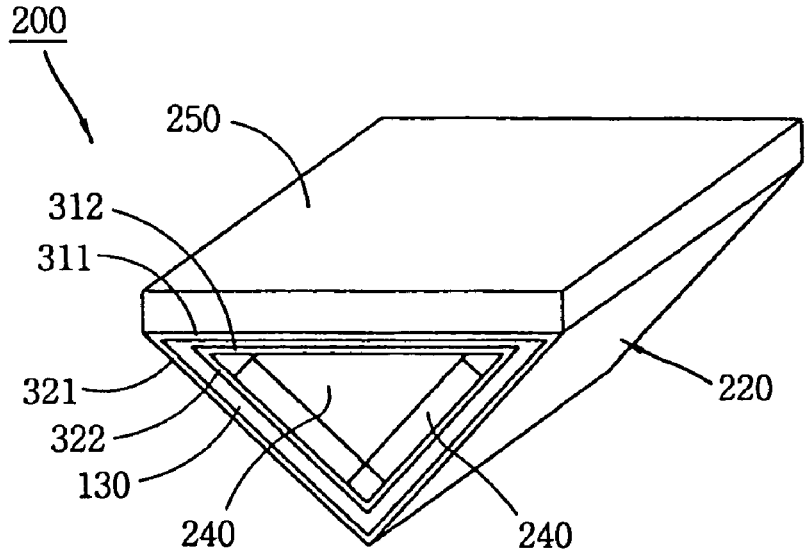

Furthermore, an explosive reactive armor 200 in accordance with a third embodiment of the present invention, as shown in FIG. 6, is formed by modifying the basic shape of the explosive reactive armor 100 with the momentum transfer mechanism. Thus, the explosive reactive armor 200 is constructed by adding flying elements 240 and 250 onto a front outer plate 311 and a rear inner plate 322, respectively, as well as having a triangular closed loop form. The operational principle of the third embodiment is similar to that of the first embodiment. In the third embodiment, the ongoing path of the detonation wave is shortened to minimize an operation time of the flying elements 240. Accordingly, the duration of the interaction with the threat 2 can be extended to improve the protection effect. The rear surface profile, on the other hand, may be formed in various shapes such as a diamond, a tetragon, or a square, depending on the intention, as well as a triangle, so as to adjust the propagation time of the detonation wave. Here, the flying element 250 added to the front outer plate 311 increases a rigidity of the front surface of the explosive reactive armor 200 and increases an amount of the flying element for the interaction with the threat 2, thereby improving the protection effect.

Figure 7:
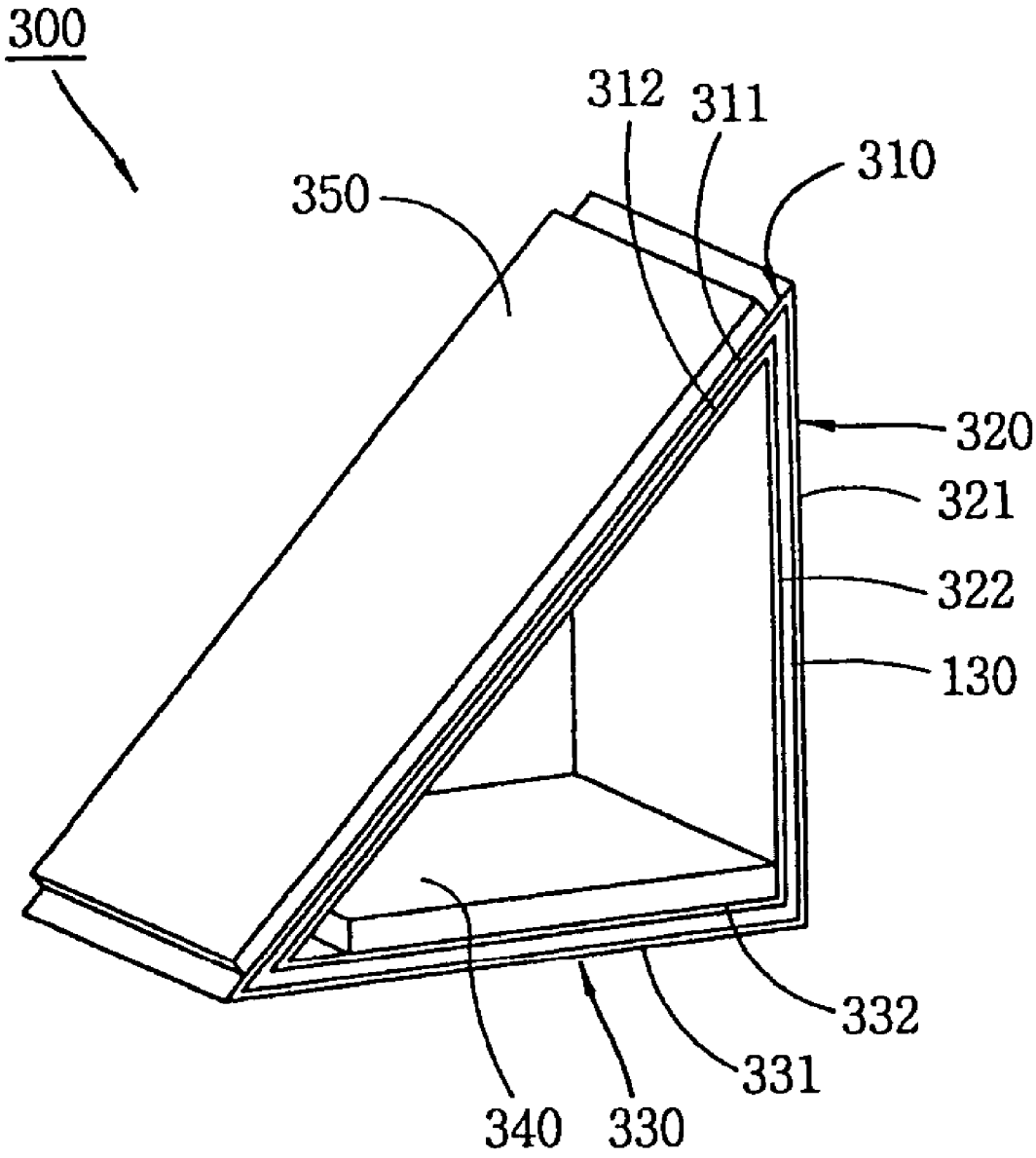

An explosive reactive armor 300 in accordance with a fourth embodiment of the present invention, as shown in FIG. 7, is also formed by modifying the basic arrangement of the explosive reactive armor 100 with the momentum transfer mechanism. In the explosive reactive armor 300, the form of the explosive reactive armor is arranged as a right triangle (the angle between first and second rear plate members 320 and 330 is about 80° to 100°), and flying elements 340 and 350 are added only onto the front plate member 310 and the second rear plate member 330 parallel with the ongoing direction of the threat 2. In such construction, because the front surface flying element 350 is oblique with respect to the ongoing direction of the threat 2, a dynamic plate thickness of the flying elements 310 and 350 can be increased, while the second rear plate member 330 travels transversely to the ongoing direction of the threat according to the propagation of the detonation wave to apply a momentum in a transverse direction to the threat 2. As a result, the ongoing direction of the threat 2 can be greatly disturbed thereby to achieve the protection effect.

In addition, although not shown in the accompanying drawings, various techniques and arrangements as follows may be embodied on the basis of the aforementioned embodiments. First, there may be applied a technique by which a pre-crack is formed in the surface of the rear inner plate. The explosive reactive armor with the momentum transfer mechanism should take into consideration on a propagating path and a propagating time of the detonation wave in order to provide an appropriate operation time of the rear surface flying element for transferring the momentum. When the threat such as a shaped charge jet flies fast, the tip of the threat may penetrate the explosive reactive armor before the detonation wave arrives at the rear surface because of the necessary time for traveling of the detonation wave. In order to alleviate this problem, if a pre-crack is formed in the rear surface, each part of the flying plate can be easily separated by the detonation wave, which allows for an individual flight. So, it can arrive at the threat more rapidly. This leads to the interaction with the projectile within a shorter time compared to the case of entire plate flying, which gives the protection effect against the initial part of the high speed threat. Second, there may be applied technique for increasing a thickness of the rear plate member itself instead of adding additional flying elements. Because the rear plate member of the explosive reactive armor with the momentum transfer mechanism operates as a momentum transfer element which applies a shear force to the threat, an increase of a mass of the rear plate member induces an increased momentum of the flying element such that the protection effect can be improved. Third, in order to overcome a limitation on an installation space, there may be applied technique for adjusting a size of the explosive reactive armor and a scheme for modifying its type and installation arrangement in order to compensate for any vulnerabilities which necessarily arises when mounting the explosive reactive armor as a modular type.

As described so far, the present invention provides an explosive reactive armor with a momentum transfer mechanism integrated with a thickness increase mechanism. In this explosive reactive, armor with the momentum transfer mechanism, the flying element always travels with a normal angle or an oblique angle with respect to the ongoing direction of the threat such that the momentum of the flying element is transferred to the threat effectively. As a result of this, shear forces are induced over the entire length of the threat and thus the threat can be destroyed or effectively mitigated. Therefore, the protection effect can always be achieved regardless of the impact angle of the threat, thereby providing the protection capability even in case of a perpendicular impact which is the most vulnerable case for the existing explosive reactive armor.

Also, in the explosive reactive armor according to the present invention, the explosive charges of the front and rear plate members are connected with each other. Thus, the explosive reactive armor operates by the detonation wave of the reactive material itself which propagates at a high speed (of which a propagation speed is faster than an ongoing speed of the threat), not by the impact between the threat and the explosive at the rear surface part. Therefore, unlike the prior explosive reactive armor which is not very effective for the threat having a short length (e.g., EFP), the explosive reactive armor with the momentum transfer mechanism according to the present invention offers a sufficient interaction of the flying element with the threat by inducing pre-detonation of the rear plate member's reactive material before the impact of the threat on the rear plate member, which leads to a superior protection effect regardless of the type of threat.

Furthermore, in the explosive reactive armor with the momentum transfer mechanism according to the present invention, the flying elements of the rear plate member travel sequentially according to an arrival of the detonation wave from the impact point of the threat, and thus the protection capability can effectively be improved by an interaction between the flying elements and the threat.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalents of such metes and bounds are therefore intended to be embraced by the appended claims.

What is claimed is:

1. An explosive reactive armor comprising:

a front plate member;

a rear plate member connected with and providing a gap with the front plate member forming a closed loop having an inner cavity therebetween, said closed loop being in the form of a triangle;

a reactive material filled within the front plate member and the rear plate member, said reactive material filling the entire gap between the pair of plates forming said front plate member and said rear plate member and extending along said closed loop about said inner cavity, wherein the front plate member is formed to be flat and the rear plate member is formed to have a polygonal shape, and with a flying element being mounted on one said plate member so that a threat is enabled to advance through the inner cavity toward the rear plate member after impacting the front plate member.

2. The armor of claim 1, wherein said flying element is mounted on an outer surface of the front plate member.

3. The armor of claim 2, wherein the flying element is made of at least one of metal, ceramic material, plastic, and a composite material.

4. The armor of claim 1, wherein a pre-crack is preformed in the rear plate member.

5. The armor of claim 1, wherein the rear plate member has a greater mass than the front plate member.

6. An explosive reactive armor comprising:

a front plate member;

a rear plate member connected with and providing a gap with the front plate member forming a closed loop having an inner cavity therebetween;

wherein the front plate member is formed of a pair of flat plates, the rear plate member being formed of two adjacent pairs of flat spaced plates with an angle subtended between the pairs of about 80 to 100 degrees, so as to form a closed loop therewith, and a reactive material entirely filling the gaps between each of said spaced plates of each said pair, and with a flying element mounted on only one of the rear flat plates, so that a threat is enabled to advance through the inner cavity toward the rear plate member after impacting the front plate member.

7. The armor of claim 6, wherein the flying element is made of at least one of metal, ceramic material, plastic, and a composite material.

8. The armor of claim 6, wherein a plurality of the flying elements are installed on the rear plate member facing the inside of the closed loop.

* * * * *